United States Patent [19]

Bulgarelli

[11] Patent Number: 4,612,716

[45] Date of Patent: Sep. 23, 1986

[54] TROLLEY MOUNTED, HAND-PROPELLED HOME/PROFESSIONAL DIGGER, OR 'MINI-DIGGER'

[75] Inventor: Vittorio Bulgarelli, Ravenna, Italy

[73] Assignee: Beltrami Osmano, Ravenna, Italy

[21] Appl. No.: 805,970

[22] Filed: Dec. 6, 1985

[30] Foreign Application Priority Data

Dec. 12, 1984 [IT] Italy ..... 46314 A/84

[51] Int. Cl.[4] ..... E02F 5/02

[52] U.S. Cl. ..... 37/103

[58] Field of Search ..... 37/103, 117.5; 414/685, 414/696, 722, 920; 280/200, 291, 293, 295–296, 475, 47.11, 47.13 R, 47.34; 172/42–43, 329, 332, 351, 358, 361

[56] References Cited

U.S. PATENT DOCUMENTS

| | | | |
|---|---|---|---|
| 94,303 | 8/1869 | Gore | 37/103 |
| 3,964,182 | 6/1976 | Pomeret et al. | 37/103 |
| 4,130,952 | 12/1978 | Dion | 172/358 |
| 4,503,630 | 3/1985 | Riley | 172/43 |

FOREIGN PATENT DOCUMENTS

| | | | |
|---|---|---|---|
| 1096115 | 12/1967 | United Kingdom | 37/103 |
| 1205044 | 9/1970 | United Kingdom | 37/103 |
| 1508605 | 4/1978 | United Kingdom | 37/103 |
| 2092104 | 8/1982 | United Kingdom | 37/103 |

*Primary Examiner*—E. H. Eickholt

*Attorney, Agent, or Firm*—Fay, Sharpe, Fagan, Minnich & McKee

[57] ABSTRACT

A small trolley-mounted hand-propelled home or professional digger is disclosed, or a 'mini-digger', comprising a power pack carried by the trolley and an earth-moving hinged boom assembly with scoop mounted to the front of the trolley, the trolley itself being provided with handlebars and with a pair of wheels or tracks for propulsion purposes, as well as with two front stabilizers and a rear footboard on which the user stands during digging operations. The hinged boom comprises a main stage and a tilt stage which can be folded together parallel and vertical, almost touching, so as to remain compact and balance the weight of the power pack when the 'mini-digger' is in transit, and can be swung about a vertical axis.

7 Claims, 5 Drawing Figures

2
3
6a
7
18
6
13
4
16
14
1b
21
1a
5
1
11
8
17
12
17
20
9
10
19

17
14
10
2
4
12
1b
13
19
8
1b
1a
3
9
5
19
7
2
17
12
16
10

TROLLEY MOUNTED, HAND-PROPELLED HOME/PROFESSIONAL DIGGER, OR 'MINI-DIGGER'

BACKGROUND OF THE INVENTION

The invention discloses a small trolley-mounted home or professional digger which is propelled by hand and comprises a prime mover and hydraulic power section, carried by the trolley and consisting of conventional mechanical components and actuators such as are used for digging duties, and an earth-moving section consisting of a hinged boom assembly having a first hydraulic ram which raises and lowers a main boom stage, a second hydraulic ram which operates a tilt boom stage hinged to the main boom stage, and a third hydraulic ram for control of a scoop hinged to the tilt boom stage.

The 'mini-digger' disclosed differs from diggers currently available on the market inasmuch as:

a—the unit is hand-propelled;

b—stabilization of the unit is achieved by hand;

c—the dimensions of the unit are much reduced with respect to those of conventional diggers; adjustable front stabilizers are provided which operate in conjunction with a folding footboard affording firm stance and grip; the scoop is hinged in such a way that the boom will fold up into a balanced vertical position with the mobile stages parallel and close together; the overall design affords economy of transportation, and permits of crating the entire unit in a compact container;

d—the 'mini-digger' is designed to provide an economical option for those jobs which normally are undertaken by hand, or for which the use of a conventional digger is prohibitive by reason of the excessive cost, weight and encumbrance.

The jobs in question would be small scale excavations such as are required for work on water supply pipes, drains, gas mains, telephone and electrical power supply lines, in parks, gardens and nurseries, when laying foundations, etc.; a digger according to the invention thus satisfies both professional and home requirements.

SUMMARY OF THE INVENTION

The object of meeting such requirements with a small hand-propelled digger is realized by mounting the entire power pack and earth-moving assembly (including a prime mover for the hydraulics, the oil tank, and the control valve and handles for operation of the boom and scoop) on a simple service platform consisting of a trolley with handlebars, running on two or more wheels or crawler tracks and provided at the front end with separate, independently adjustable stabilizers. The rear end of such a trolley is provided with a folding footboard that can be lowered to the ground, positioned, and anchored so as to create a rear stand with the wheels raised up off the ground thereby furnishing means of stabilization which are ballasted further by the weight of the operator, who stands on the footboard itself.

BRIEF DESCRIPTION OF THE DRAWINGS

The invention will now be described in detail with the aid of the accompanying drawings, in which.

DESCRIPTION OF THE PREFERRED EMBODIMENT

Figure 1:
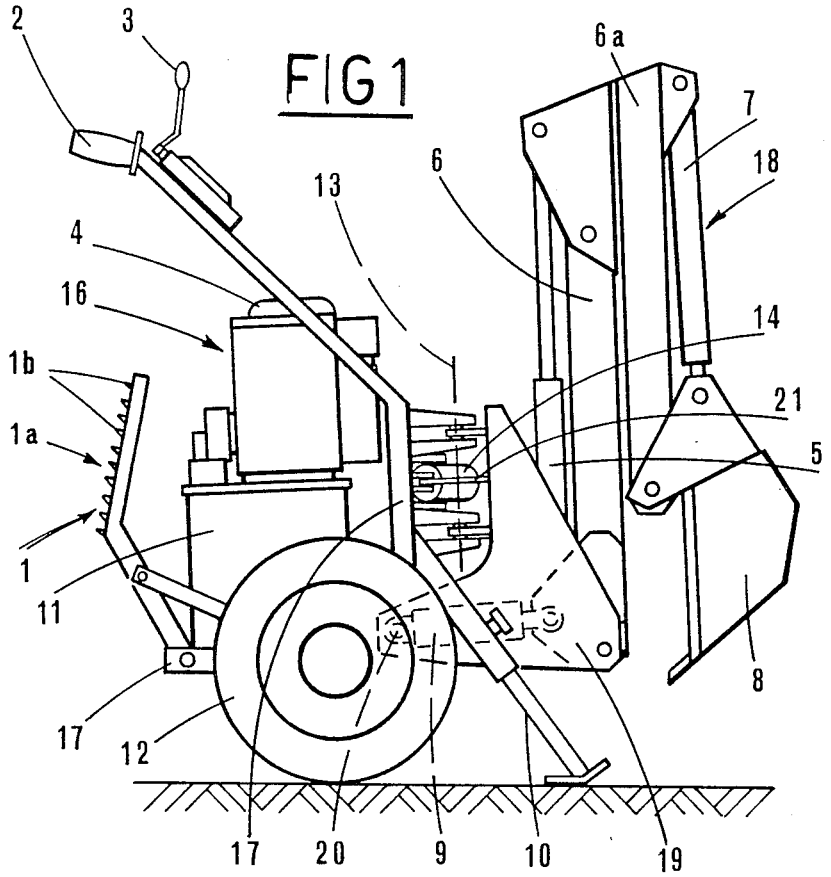
FIG. 1 is a side view of the 'mini-digger' to which the invention relates, in its folded position.

With reference first to FIG. 1 of the drawings, 1 denotes a folding footboard in the stowed position, 2 denotes a handgrip integral with each handlebar of the service trolley 17, and 3 denotes control handles by means of which the digger is operated, 4 denotes a prime mover driving the hydraulic system, which comprises a ram 5 for operation of a main boom stage 6 forming part of a boom assembly 18 that carries the digging implement, a scoop 8; the tilt stage of the boom is denoted 6*a*. 7 denotes a ram controlling movement of the scoop 8 itself; 9 denotes the lift ram.

The digger further comprises two adjustable stabilizers 10, a hydraulic power pack 11, and wheels 12 (or tracks) on which the trolley is mounted.

13 denotes the vertical axis about which the boom 18 is made to swing. 1*a* denotes the base of the footboard 1, which is provided with studs 1*b* affording grip.

The general power section 16 (comprising the prime mover 4 and power pack 11) is mounted direct to the trolley 17.

9 denotes a pair of bottom plates which are set close together and mounted rotatably about the vertical axis 13, between which the lift ram 9 is located; 20 denotes a rear ball joint by which the ram 9 is anchored. 21 denotes a horizontal control rod which is actuated by a ram 14 hinged to the trolley 17 and produces the swinging movement of the boom 18.

The plates 19, lift ram 9 and rod 21 together form a device by means of which the boom stages 6 and 6*a* are permitted to draw together into a balanced vertical position.

Figure 2:
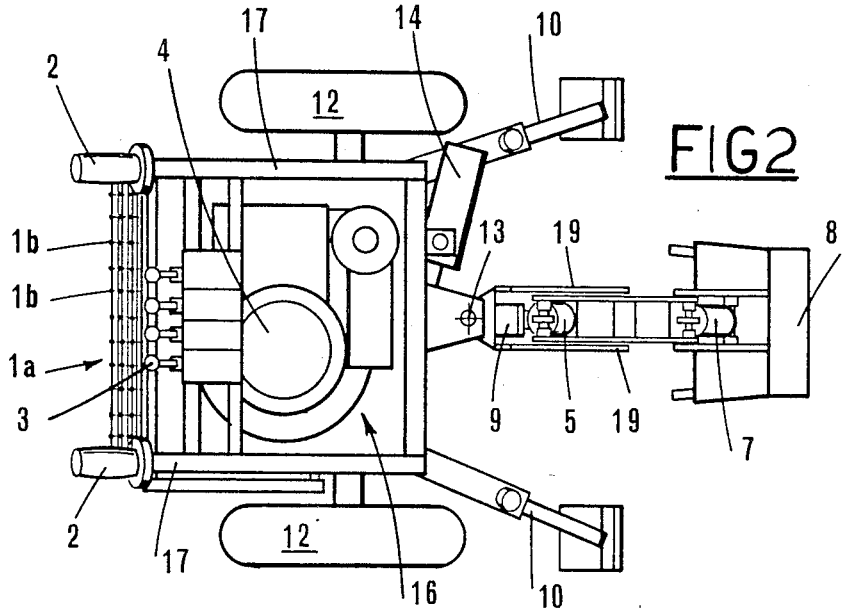
FIG. 2 shows the plan of the 'mini-digger' in FIG. 1, viewing from above.
Figure 3:
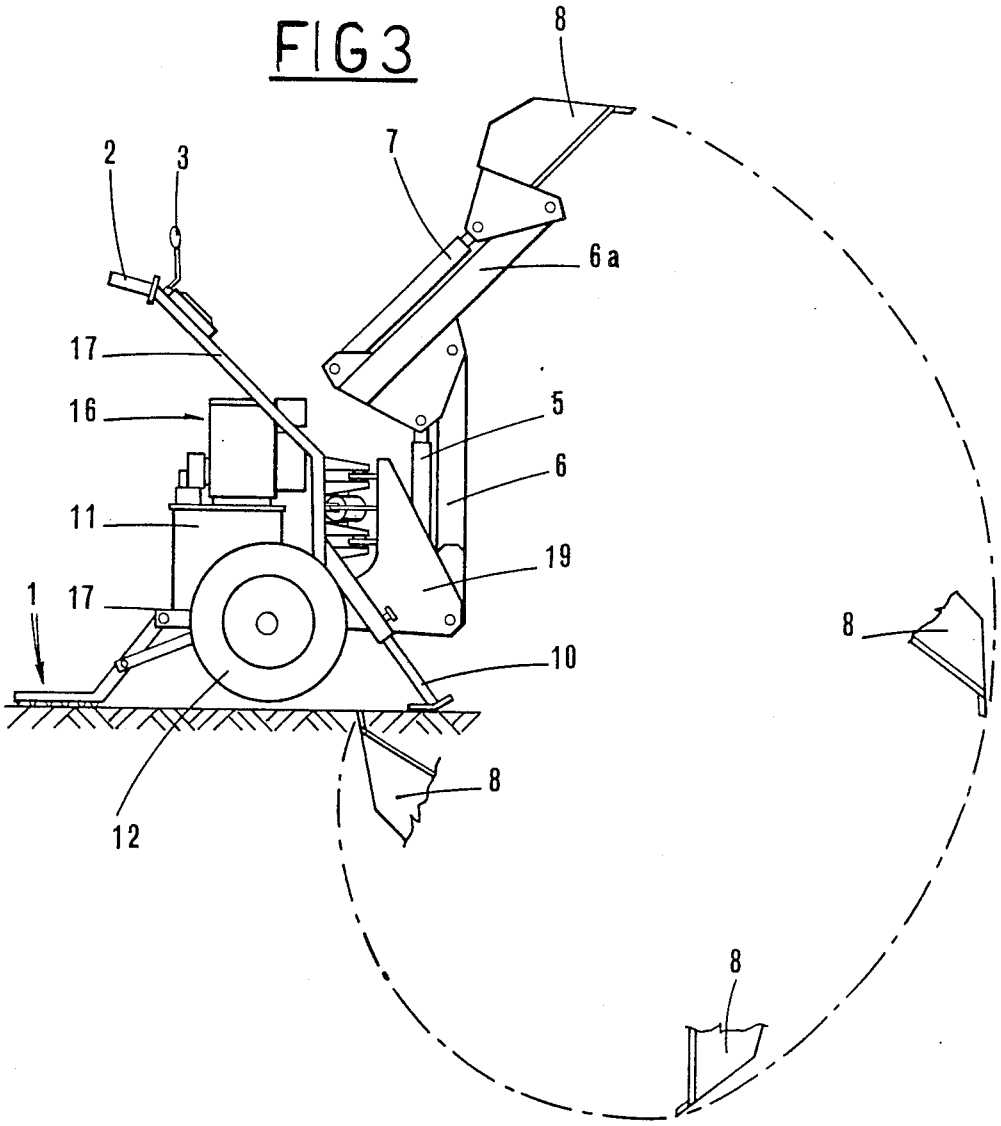
FIG. 3 is a side view of the 'mini-digger' at work, illustrating the parabola described in excavation.
Figure 4:
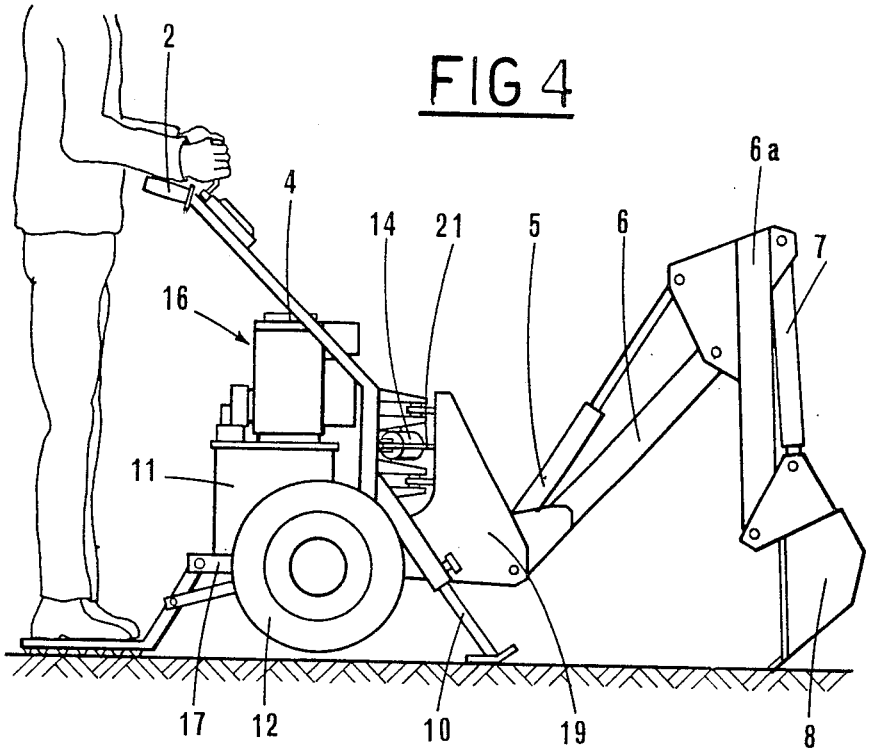
FIG. 4 is a side view of the 'mini-digger' seen in an initial working configuration.

The plan of FIG. 2 illustrates the ram 14 which produces swinging movement of the boom assembly 18. FIG. 3 illustrates the footboard 1 folded out and anchored to the ground with the trolley wheels raised clear, and demonstrates how the stabilizers 10 and the footboard 1 together hold the trolley stable. 15 denotes the parabola described by the scoop 8. FIG. 4 illustrates the position of the 'mini-digger' and shows how the operator stands on the footboard 1 during operation of the unit, with the wheels clear of the ground and the stance provided by the footboard 1 and the stabilizers 10.

Figure 5:
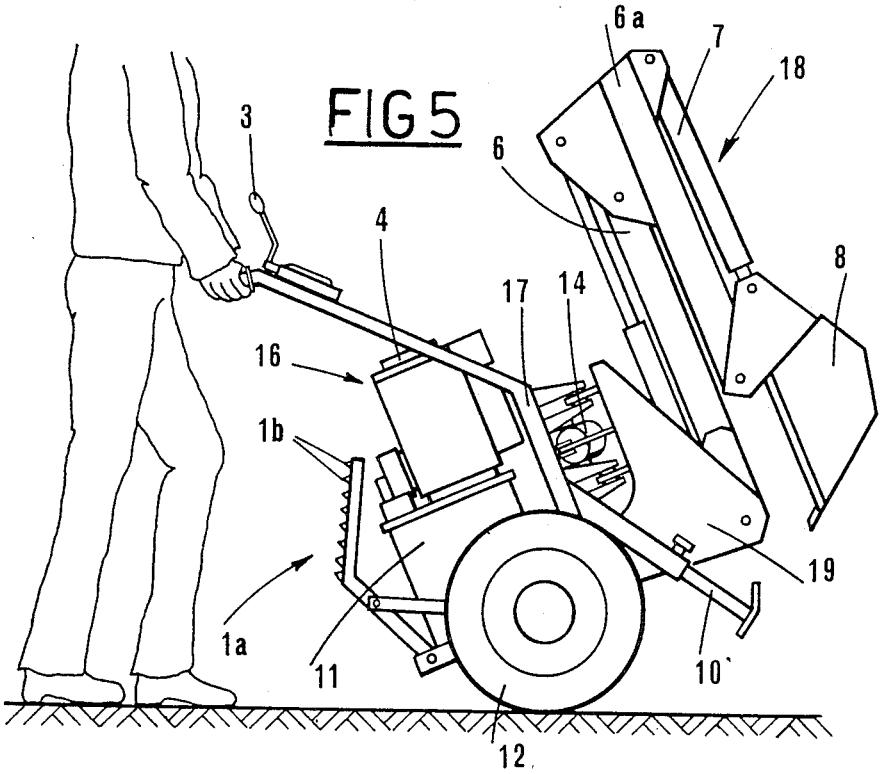
FIG. 5 is a side view of the 'mini-digger' in folded position, being propelled by the operator.

FIG. 5 illustrates the position of the digger in its fully folded-away condition, being wheeled by the operator; the wheels 12 are grounded, the footboard 1 stowed, the stabilizers 10 retracted, and the boom stages 6 and 6*a*, which operate the scoop 8, folded together. This view also provides an idea of the dimensional and balance features of the unit.

What is claimed:

1. A small trolley-mounted home or professional digger, or 'mini-digger' propelled by hand and comprising:

a trolley provided with a handlebar at rear, and at least two wheels or tracks;

at least two height-adjustable front stabilizers;

a least one footboard at rear that can be folded from a first fully-stowed position down to a second fully folded-out operating position in which a wide, firm stance is created in conjunction with the stabilizers independently of the wheels or tracks;

a prime mover and hydraulic power section carried by the trolley;

an earth-moving section consisting of a hinged boom and scoop assembly, mounted to the front central part of the trolley, rotatable about a vertical axis, and comprising a first hydraulic ram raising and lowering a main boom stage, a second hydraulic ram operating a tilt boom stage hinged to the main boom stage, and a third hydraulic ram controlling the scoop, which is hinged to the tilt boom stage, embodied such that the entire boom assembly can be folded away when not in use, into a compact position wherein the main stage and tilt stage are disposed parallel and vertical, almost touching; and handles mounted to the trolley handlebar which provide for control of digging operations.

2. 'Mini-digger' as in claim 1, wherein the wheels or tracks are driven.

3. 'Mini-digger' as in claim 1, wherein the wheels or tracks are idle.

4. 'Mini-digger' as in claim 1, during the operation of which the stabilizers are extended from the trolley through a straight line, and the footboard is rotated from the stowed position to the folded-out position.

5. 'Mini-digger' as in claim 1, wherein the hinged boom assembly is carried and flanked by two bottom plates located close together and able to swing about the vertical axis, and wherein the first hydraulic lift ram is positioned between the two plates, hinged at front to the main boom stage, and anchored at rear to the trolley by a ball joint.

6. 'Mini-digger' as in claim 1 wherein the footboard has a base which when planted on the ground is firmly anchored thereby by a plurality of studs.

7. 'Mini-digger' as in claim 5, wherein the plates are integral with a horizontal rod actuated by a ram hinged to the trolley, thus providing means by which the boom is made to swing about the vertical axis.

* * * * *